US008596743B2

(12) United States Patent
Suzuki et al.

(10) Patent No.: US 8,596,743 B2
(45) Date of Patent: Dec. 3, 2013

(54) LIQUID EJECTING HEAD, LIQUID EJECTING HEAD UNIT, LIQUID EJECTING APPARATUS AND METHOD OF MANUFACTURING LIQUID EJECTING HEAD

(75) Inventors: Shigeki Suzuki, Shiojiri (JP); Katsuhiro Okubo, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 262 days.

(21) Appl. No.: 13/045,789

(22) Filed: Mar. 11, 2011

(65) Prior Publication Data

US 2011/0242190 A1 Oct. 6, 2011

(30) Foreign Application Priority Data

Mar. 30, 2010 (JP) ..... 2010-079650

(51) Int. Cl.
*B41J 29/38* (2006.01)
*B41J 2/015* (2006.01)
*B41J 2/135* (2006.01)

(52) U.S. Cl.
USPC ..... 347/20; 347/9; 347/44

(58) Field of Classification Search
USPC ..... 347/20, 85–86, 9, 44, 63
See application file for complete search history.

(56) References Cited

U.S. PATENT DOCUMENTS 7,837,309 B2 * 11/2010 Owaki ..... 347/85
2008/0316274 A1 12/2008 Kondo

FOREIGN PATENT DOCUMENTS

| | | | |
|---|---|---|---|
| JP | 2003-011383 | | 1/2003 |
| JP | 2005-225219 | | 8/2005 |
| JP | 2005225219 A | * | 8/2005 |
| JP | 2006-272885 | | 10/2006 |
| JP | 2009-000978 | | 1/2009 |

* cited by examiner

*Primary Examiner* — Jason Uhlenhake
(74) *Attorney, Agent, or Firm* — Workman Nydegger

(57) ABSTRACT

The circuit board holding section between the first and second holding members is sealed by an adhesive in an area other than an area where a connection wiring is connected to the circuit board, the first and second holding members are fixed to each other by engaging engaging claws, which are provided in two or more side surfaces at the outer circumference of one of the first and second holding members, with the other holding member, and the first and second holding members are fixed to each other by screw members.

19 Claims, 11 Drawing Sheets

LIQUID EJECTING HEAD, LIQUID EJECTING HEAD UNIT, LIQUID EJECTING APPARATUS AND METHOD OF MANUFACTURING LIQUID EJECTING HEAD

The entire disclosure of Japanese Patent Application No: 2010-079650, filed Mar. 30, 2010 are expressly incorporated by reference herein.

BACKGROUND

1. Technical Field

The present invention relates to a liquid ejecting head ejecting a liquid from nozzle openings, a liquid ejecting head unit having the liquid ejecting head, a liquid ejecting apparatus and a method of manufacturing the liquid ejecting head.

2. Related Art

As a representative example of liquid ejecting heads discharging liquid droplets, an ink jet recording head discharging ink droplets can be exemplified. As this ink jet recording head, for example, a head has been proposed including a plurality of head main bodies which discharge ink droplets from nozzle openings and a common liquid introduction member (corresponding to a holding member) which is fixed to the plurality of head main bodies and supplies ink from a liquid storage member storing the ink to the head main bodies (for example, see JP-A-2005-225219).

In addition, as the ink jet recording head, a head has been proposed having a circuit board which is connected to a pressure generator such as a piezoelectric element which changes the pressure in a pressure generating chamber of a head main body (for example, see JP-A-2006-272885).

The ink jet recording head of JP-A-2006-272885 holds a circuit board between a casing which holds a flow passage unit (corresponding to the head main body) and an introduction needle unit.

However, when ink adheres to the circuit board, a short circuit or the like occurs in the wiring provided on the circuit board, and an operation failure or a breakdown occurs.

Accordingly, there has been proposed sealing of a circuit board in a plastic casing having an opening which has a size to allow passage of a connecting wiring connected to the circuit board therethrough (for example, see JP-A-2003-11383).

In addition, an ink jet recording head has been proposed which protects a circuit board from ink with an insulating film, an adhesive or the like (for example, see JP-A-2009-978).

However, as in JP-A-2009-978, when the circuit board is protected from ink with an insulating film, an adhesive or the like, an adhesive or the like should be applied to the entire circuit board and the consumption of the adhesive or the like increases. In addition, a problem occurs in that it takes time to provide an adhesive or the like on the circuit board. Further, even when the circuit board is protected with an adhesive, a connector and therearound in which a connecting wiring is connected to the circuit board cannot be protected with the adhesive and a problem occurs in that protection cannot be completely carried out.

In addition, as shown in JP-A-2006-272885 and JP-A-2003-11383, when the circuit board is held in a holding space in a holding member which is divided into two, it is necessary to suppress the invasion of the liquid by sealing this holding space with an adhesive or the like. However, when the holding space is sealed with an adhesive or the like, adhesion failure or adhesion positional deviation occurs due to a foreign substance adhered to the adhesion surface, and connection displacement of flow passages of a head main body, a holding member and a flow passage member such as a needle member fixed to the holding member occurs and the liquid thus leaks, so a problem occurs in that the liquid invades to the inside.

Such problems occur not only in the ink jet recording head but also in a liquid ejecting head ejecting a liquid other than ink.

SUMMARY

An advantage of some aspect of the invention is to provide a liquid ejecting head in which a circuit board is reliably sealed and adhesion positional deviation between divided holding members and connection displacement of flow passages can be reduced, a liquid ejecting head unit, a liquid ejecting apparatus and a method of manufacturing the liquid ejecting head.

According to a first aspect of the invention, there is provided a liquid ejecting head including: a head main body which is provided with nozzle openings ejecting liquid; a holding member which has a first holding member holding the head main body, a second holding member mounted on the side of the first holding member opposite to the head main body via an adhesive, and a holding member flow passage communicating with a liquid flow passage of the head main body; and a circuit board which is held in a circuit board holding section corresponding to a space between the first and second holding members and to which a driving wiring of the head main body is connected. The circuit board holding section between the first and second holding members is sealed by an adhesive in an area other than an area where a connection wiring is connected to the circuit board, the first and second holding members are fixed to each other by engaging engaging claws, which are provided in two or more side surfaces at the outer circumference of one of the first and second holding members, with the other holding member, and the first and second holding members are fixed to each other by screw members.

According to the aspect, due to engagement of the first and second holding members with each other by the engaging claws, it is possible to suppress positional deviation between the first and second holding members before the adhesive is cured and the first and second holding members are fixed to each other by the screw members. In addition, just by visually checking the engagement state of the engaging claws, it is possible to ascertain the gap or whether a foreign substance is present on the contact surface or the adhesion surface between the first and second holding members.

Here, it is preferable that a flow passage member provided with an introduction hole communicating with the holding member flow passage is fixed to the side of the holding member opposite to the head main body. According to this, since it is possible to suppress positional deviation between the first and second holding members, excellent connection is achieved between the flow passages of the holding members and the flow passage member and leakage of liquid can be suppressed.

In addition, it is preferable that the holding member flow passage is provided in the first holding member. According to this, due to provision of the holding member flow passage only in the first holding member, the number of connection sites between the holding member flow passage and the introduction holes of the flow passage member and the liquid flow passage of the head main body is reduced and thus leakage of liquid can be suppressed.

In addition, it is preferable that a connection wiring insertion hole into which a connection wiring connected to the circuit board is inserted is provided in a side surface intersecting the surface to which the head main body is fixed, and is covered by a protective member which is opened to the side opposite to the surface to which the head main body is fixed. According to this, the circuit board holding section is sealed in an area other than an area where an external wiring is connected and thus invasion of liquid can be suppressed.

In addition, it is preferable that the engaging claw provided in one side at the outer circumference of one of the first and second holding members is provided so that when the engaging claw engages with the other holding member, the clearance therebetween is equal to or less than zero, and the engaging claw provided in another side is provided so that when the engaging claw engages with the other holding member, the clearance therebetween is equal to or greater than zero. According to this, engagement by the engaging claws is made easy, so assemblability can be improved.

According to a second aspect of the invention, there is provided a liquid ejecting head unit including: the liquid ejecting head according to the first aspect.

According to this aspect, assembling accuracy is improved and thus a liquid ejecting head unit can be realized in which leakage of liquid is suppressed.

According to a third aspect of the invention, there is provided a liquid ejecting apparatus including: the liquid ejecting head according to the first aspect or the liquid ejecting head unit according to the second aspect.

According to this aspect, assembling accuracy is improved and thus a liquid ejecting apparatus can be realized in which leakage of liquid is suppressed.

According to a fourth aspect of the invention, there is provided a method of manufacturing a liquid ejecting head including a head main body which is provided with nozzle openings ejecting liquid, a holding member which has a first holding member holding the head main body, a second holding member mounted on the side of the first holding member opposite to the head main body via an adhesive, and a holding member flow passage communicating with a liquid flow passage of the head main body, and a circuit board which is held in a circuit board holding section corresponding to a space between the first and second holding members and to which a driving wiring of the head main body is connected, including: engaging engaging claws which are provided in two or more sides at the outer circumference of one of the first and second holding members with the other holding member in a state in which the first and second holding members are brought into contact with each other via an adhesive; and fixing the first and second holding members to each other by screw members in a state in which the first and second holding members are engaged with each other by the engaging claws.

According to this aspect, due to engagement of the first and second holding members with each other by the engaging claws, it is possible to suppress positional deviation between the first and second holding members before the adhesive is cured and the first and second holding members are fixed to each other by the screw members. In addition, just by visually checking the engagement state of the engaging claws, it is possible to ascertain the gap or whether a foreign substance is present on the contact surface or the adhesion surface between the first and second holding members.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail on the basis of embodiments.

First Embodiment

Figure 1:
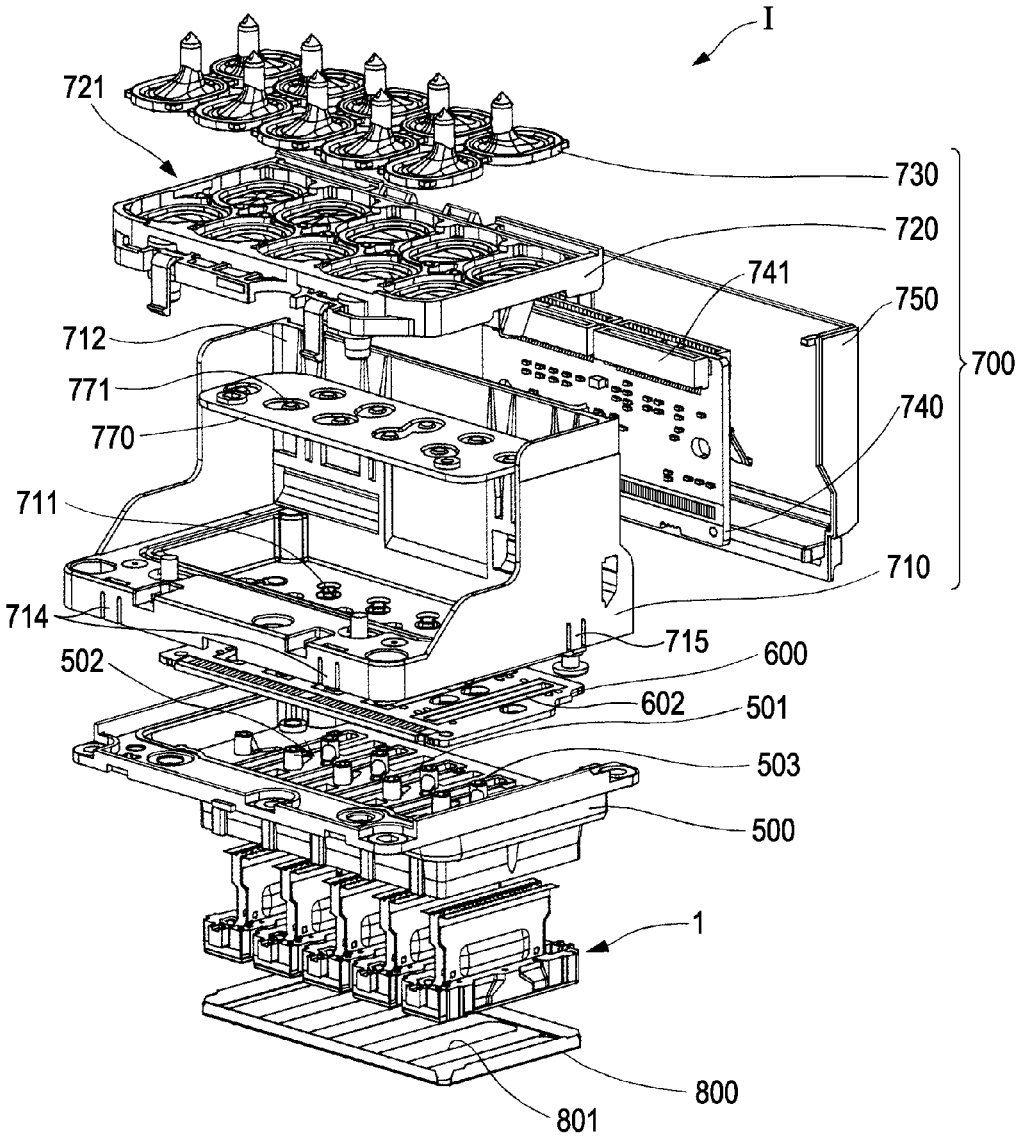
FIG. 1 is an exploded perspective view of a recording head according to a first embodiment of the invention.
Figure 2:
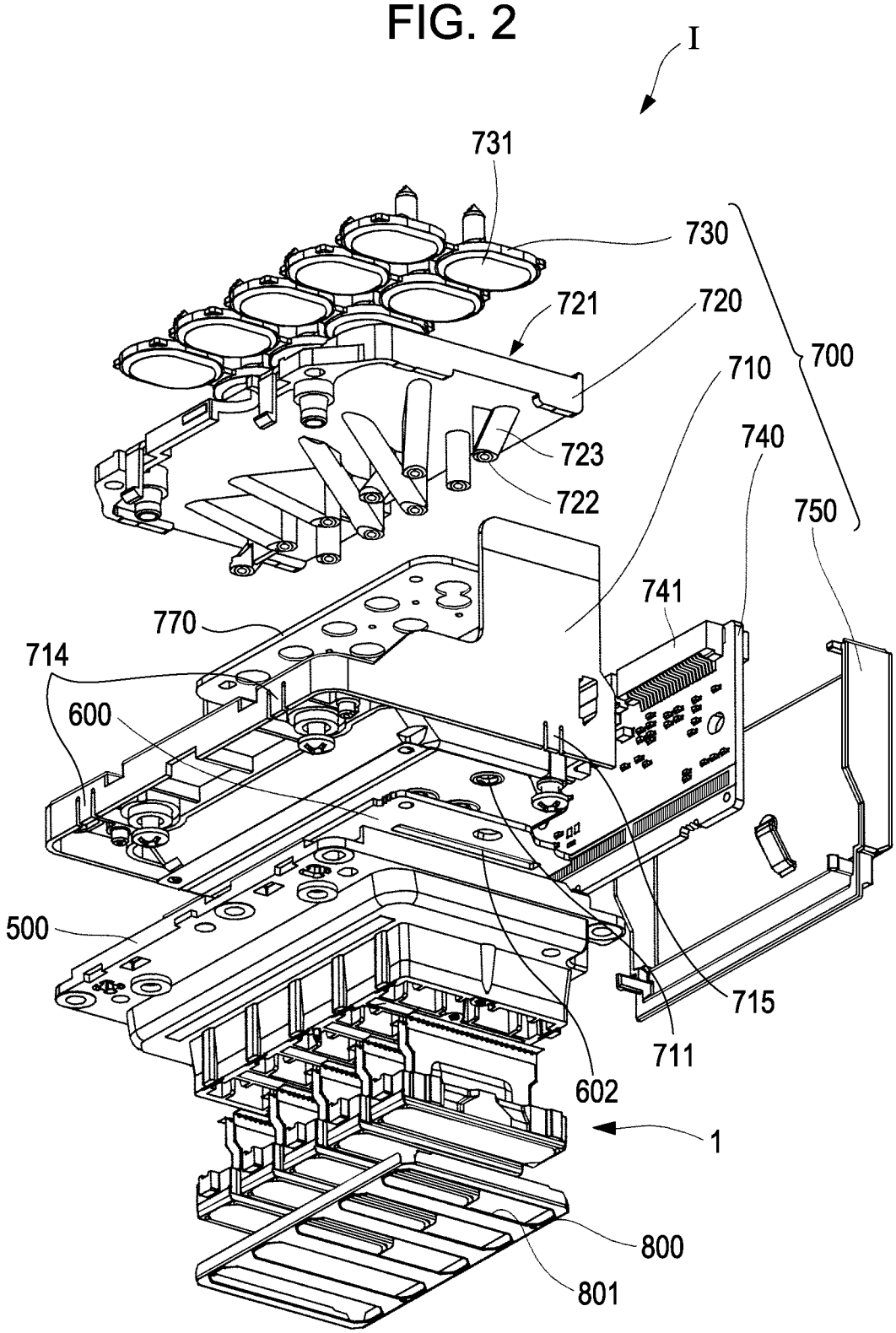
FIG. 2 is an exploded perspective view of the recording head according to the first embodiment of the invention.

FIGS. 1 and 2 are exploded perspective views of an ink jet recording head which is an example of a liquid ejecting head according to a first embodiment of the invention. As shown in FIG. 1, an ink jet recording head I includes head main bodies 1 ejecting ink, a supply passage forming member 500 to which the plurality of head main bodies 1 is fixed, a circuit board 600 provided on the side of the supply passage forming member 500 opposite to the head main bodies 1, a fixing member 700 provided on the side of the circuit board 600 of the supply passage forming member 500 and a cover head 800 provided on the side of the head main bodies 1 opposite to the supply passage forming member 500.

Figure 3:
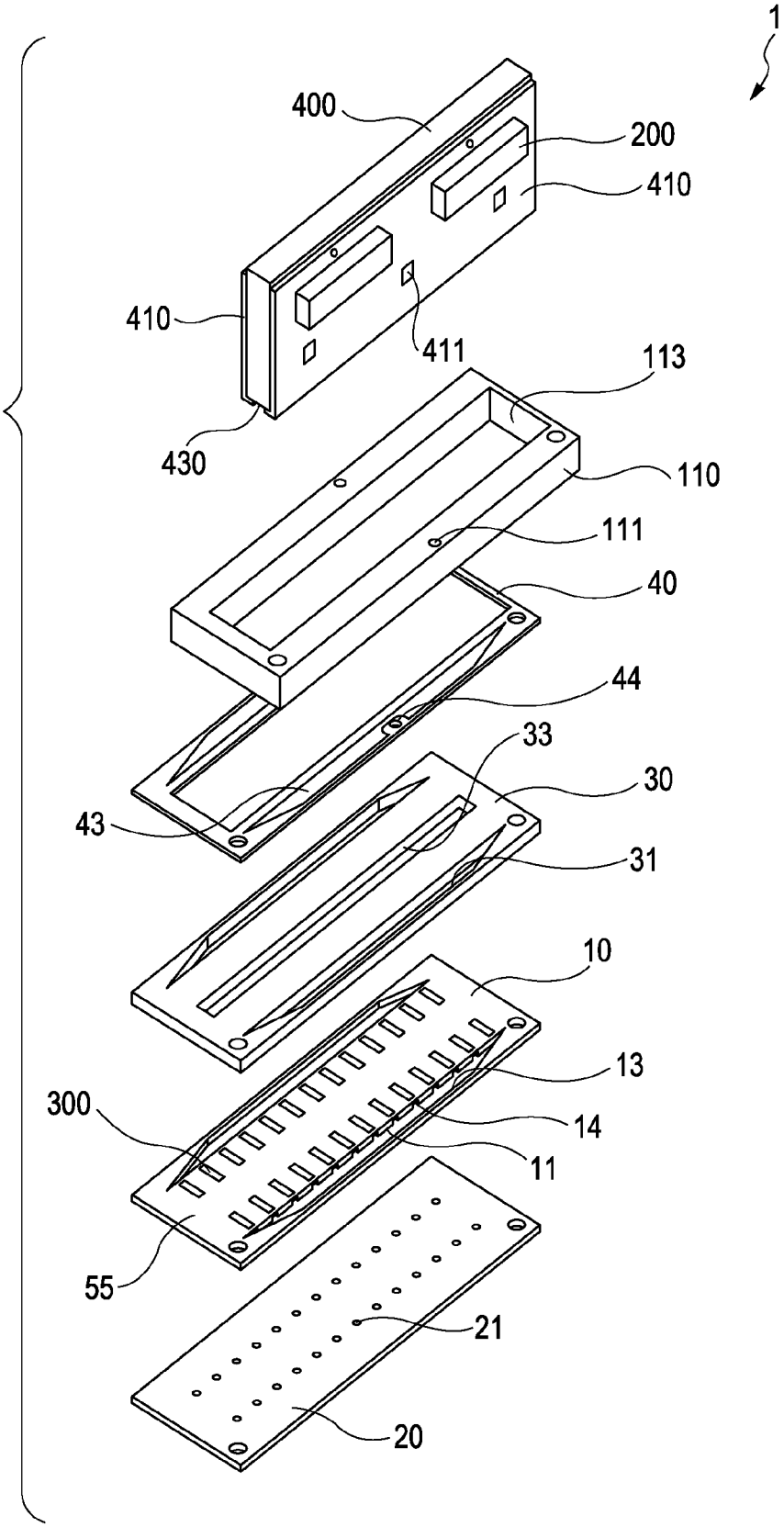
FIG. 3 is an exploded perspective view of a head main body according to the first embodiment of the invention.
Figure 4:
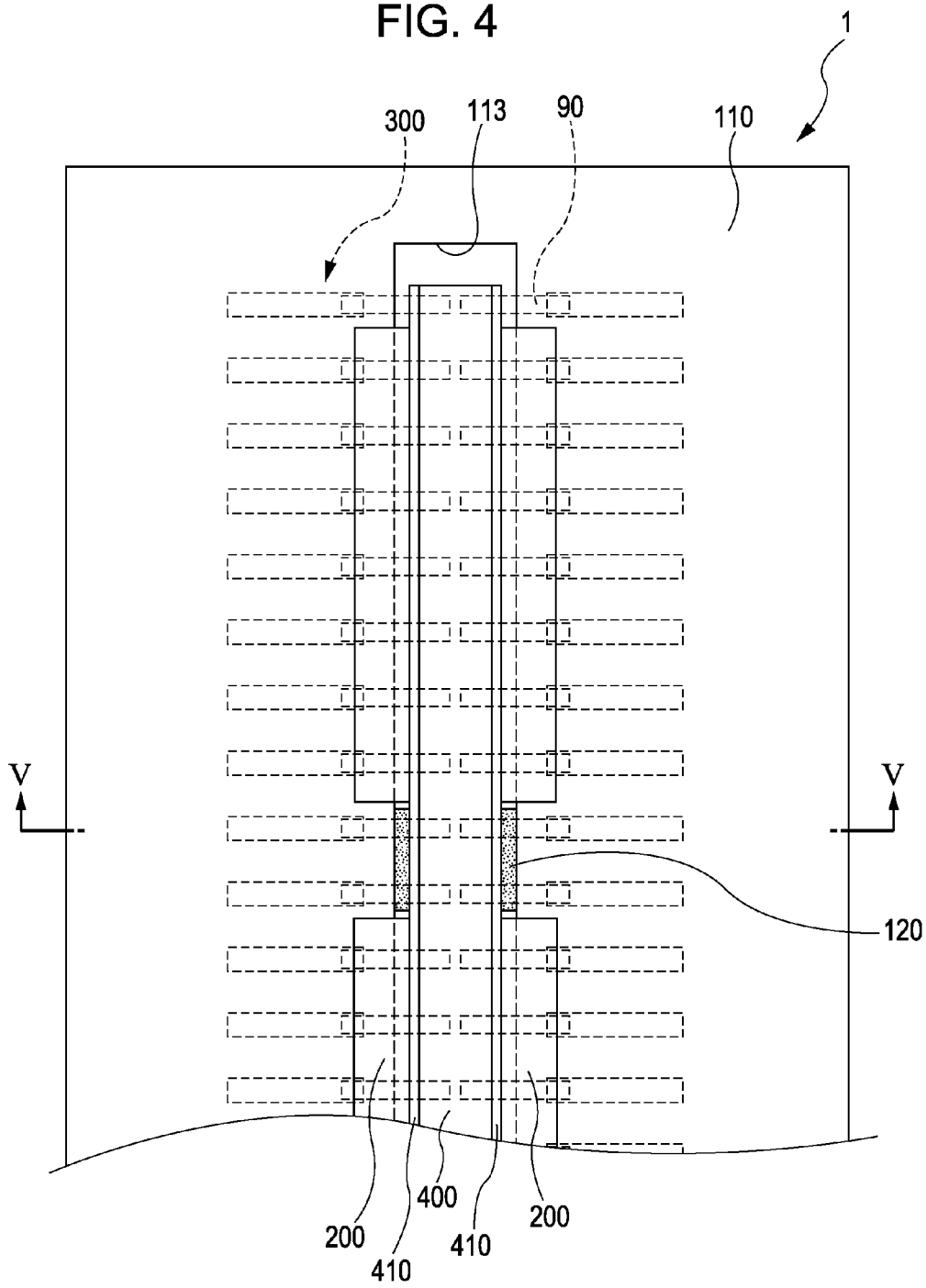
FIG. 4 is a plan view of the head main body according to the first embodiment of the invention.
Figure 5:
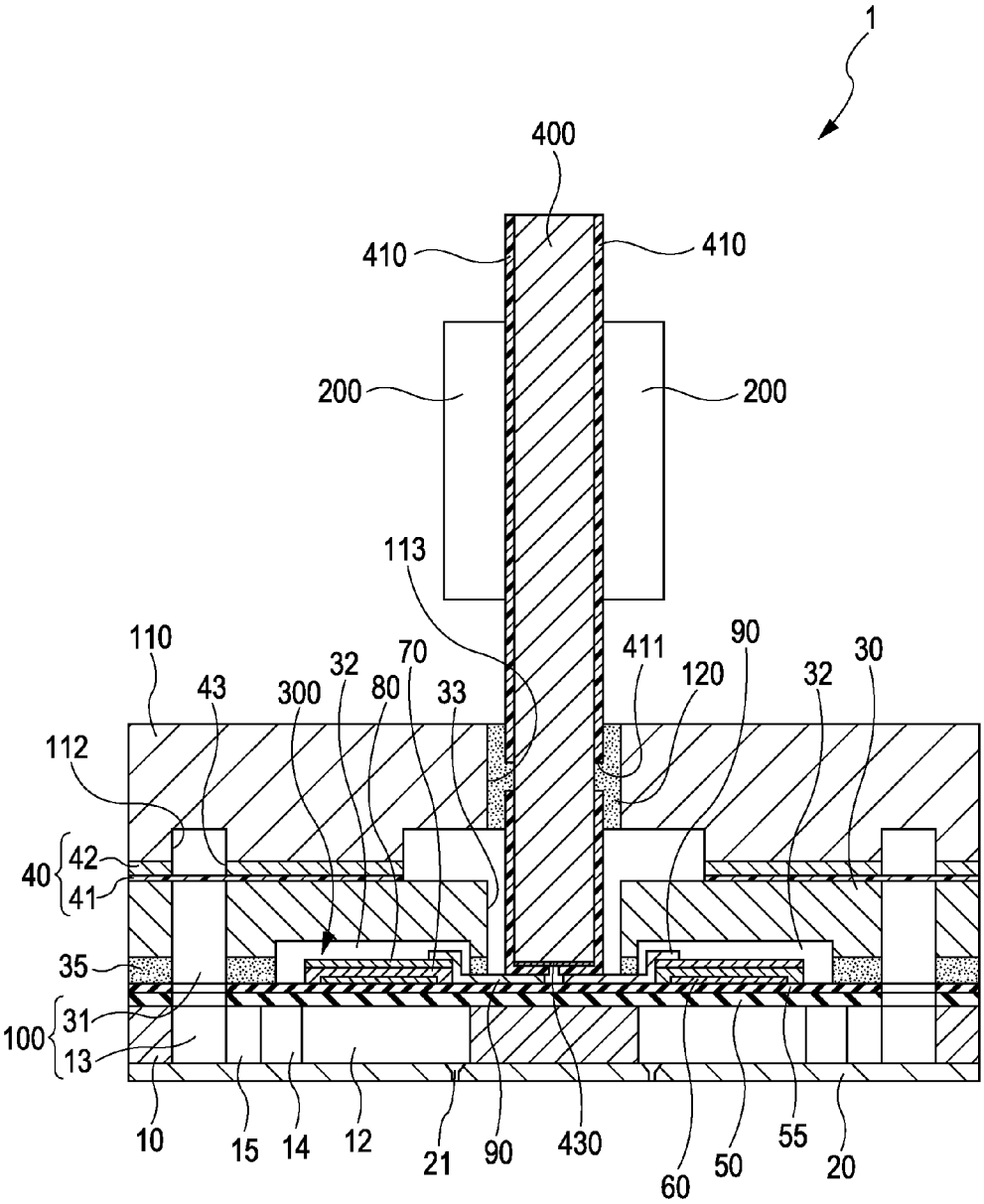
FIG. 5 is a cross-sectional view of the head main body according to the first embodiment of the invention.

First, the head main body 1 will be described in detail with reference to FIGS. 3 to 5. FIG. 3 is an exploded perspective view of the head main body according to the first embodiment of the invention, FIG. 4 is a plan view of the head main body and FIG. 5 is a cross-sectional view taken along the line V-V of FIG. 4.

A flow passage forming substrate 10 which constitutes the head main body 1 as shown in the drawing has a silicon single crystal substrate in this embodiment. On one side thereof, an elastic film 50 is formed which is made of silicon dioxide.

In the flow passage forming substrate 10, a plurality of pressure generating chambers 12 partitioned by walls 11 is provided in two rows arranged in parallel in the width direction. In addition, a communication section 13 is formed in an area outside in the longitudinal direction of the pressure generating chambers 12 of each row, and the communication section 13 and each of the pressure generating chambers 12 communicate with each other via an ink supply passage 14 and a communication passage 15 provided for each pressure generating chamber 12. The communication section 13 partially constitutes a manifold 100 which communicates with a manifold section 31 of a protective substrate 30 to be described later to serve as a common ink chamber for each row of the pressure generating chambers 12. The ink supply passage 14 is formed to have a width narrower than that of the pressure generating chamber 12 and the flow resistance of ink flowing to the pressure generating chamber 12 from the communication section 13 is kept constant therein. In this embodiment, the ink supply passage 14 is formed by narrowing the width of the flow passage from one side. However, the ink supply passage may be formed by narrowing the width of the flow passage from both sides. In addition, the ink supply passage may not be formed by narrowing the width of the flow passage but may be formed by narrowing the flow passage in the thickness direction. Further, each communication passage 15 is formed by extending the walls 11 on both sides in the width direction of the pressure generating chamber 12 toward the communication section 13 and partitioning the space between the communication section 13 and the ink supply passage 14. That is, in the flow passage forming substrate 10, the ink supply passage 14 having a cross-section area smaller than the cross-section in the width direction of the pressure generating chamber 12 and the communication passage 15 communicating with this ink supply passage 14 and having a cross-section area larger than the cross-section area in the width direction of the ink supply passage 14 are partitioned by the plurality of walls 11.

In addition, on the side of the opening surface of the flow passage forming substrate 10, a nozzle plate 20, which is provided with nozzle openings 21 communicating with the pressure generating chambers 12 in the vicinity of the ends thereof on the opposite side to the ink supply passages 14, is fixed by an adhesive, a thermal bonding film or the like. In this embodiment, since two rows of the pressure generating chambers 12 are arranged in parallel in the flow passage forming substrate 10, the nozzle openings 21 are arranged in parallel in two nozzle arrays in a head main body 1. The nozzle plate 20 is made of, for example, glass, ceramics, a silicon single crystal substrate, stainless steel or the like.

On the other hand, on the opposite side to the opening surface of the flow passage forming substrate 10, the elastic film 50 is formed as described above and an insulator film 55 is formed on this elastic film 50. Further, on this insulator film 55, a first electrode 60, a piezoelectric layer 70 and a second electrode 80 are sequentially laminated and constitute a piezoelectric element 300 which is a pressure generating element in this embodiment. Here, the piezoelectric element 300 is a portion including the first electrode 60, the piezoelectric layer 70 and the second electrode 80. In general, any one of the electrodes of the piezoelectric element 300 serves as a common electrode and the other electrode thereof and the piezoelectric layer 70 are patterned for each pressure generating chamber 12. Here, a portion which has any one of the patterned electrodes and piezoelectric layer 70 and in which piezoelectric distortion occurs due to the application of a voltage to both of the electrodes is referred to as a piezoelectric active section. In this embodiment, the first electrode 60 on the side of the flow passage forming substrate 10 serves as a common electrode of the piezoelectric element 300 and the second electrode 80 serves as an individual electrode of the piezoelectric element 300, but there are no problems even if the roles are reversed in accordance with the situation of the driving circuit or wiring. In addition, here, the piezoelectric element 300 and the oscillating plate which is displaced by the driving of the piezoelectric element 300 are combined and referred to as an actuator device. In the above-described example, the elastic film 50, the insulator film 55 and the first electrode 60 act as the oscillating plate, but the invention is not limited thereto. For example, without provision of the elastic film 50 and the insulator film 55, only the first electrode 60 may act as the oscillating plate. In addition, the piezoelectric element 300 also may substantially serve as the oscillating plate.

The piezoelectric layer 70 is made of a piezoelectric material which is formed on the first electrode 60 and shows an electromechanical conversion action, particularly, a ferroelectric material having the perovskite structure among piezoelectric materials. As the piezoelectric layer 70, a crystal film having the perovskite structure is preferably used. For example, a ferroelectric material such as piezoelectric zirconate titanate (PZT) or a material prepared by adding a metal oxide such as niobium oxide, nickel oxide or magnesium oxide to the ferroelectric material is preferably used.

In addition, for example, a lead electrode 90 (connecting terminal) extending onto the insulator film 55 and made of gold (Au) or the like is connected to the second electrode 80 which is an individual electrode of the piezoelectric element 300. The lead electrode 90 is connected to the second electrode 80 at one end thereof, and the other end thereof extends between the rows of the piezoelectric elements 300 arranged in parallel. In greater detail, it is connected to a flexible wiring member (COF board 410) which is a driving wiring, to be described later, of the head main body 1.

The protective substrate 30 having manifold sections 31 constituting at least a part of the manifold 100 is joined onto the flow passage forming substrate 10 having the piezoelectric elements 300 formed therein, that is, onto the first electrode 60, the insulator film 55 and the lead electrode 90 via an adhesive 35. In this embodiment, this manifold section 31 penetrates the protective substrate 30 in the thickness direction and is formed in the width direction of the pressure generating chamber 12. As described above, the manifold section communicates with the communication section 13 of the flow passage forming substrate 10 and constitutes the manifold 100 which is a common ink chamber of the pressure generating chambers 12. In this embodiment, the communication sections 13 constituting the manifold 100 are provided in the flow passage forming substrate 10, but the invention is not particularly limited thereto. For example, the communication section 13 of the flow passage forming substrate 10 may be divided into more than one for each pressure generating chamber 12 so that only the manifold section 31 serves as the manifold. In addition, for example, only the pressure generating chambers 12 may be provided in the flow passage forming substrate 10 and the ink supply passage 14 communicating the manifold with the respective pressure generating chambers 12 may be provided in the member (for example, the elastic film 50, the insulator film 55) interposed between the protective substrate 30 and the flow passage forming substrate 10.

In addition, in an area opposed to the piezoelectric element 300 of the protective substrate 30, a piezoelectric element holding section 32 is provided which is a holding section having a space not disturbing the movement of the piezoelectric element 300. The piezoelectric element holding section 32 may have a space not disturbing the movement of the piezoelectric element 300, and this space may be sealed or may not be sealed. In this embodiment, since the piezoelectric elements 300 arranged in parallel are provided in two rows, the piezoelectric element holding section 32 is provided in association with each row of the piezoelectric elements 300 arranged in parallel. That is, in the protective substrate 30, two piezoelectric element holding sections 32 are provided in the direction of the rows of the piezoelectric elements 300 arranged in parallel.

For the protective substrate 30, a material having almost the same coefficient of thermal expansion as that of the flow passage forming substrate 10, for example, glass, a ceramic material or the like is preferably used. In this embodiment, the protective substrate is formed using a silicon single crystal substrate, which is the same material as the flow passage forming substrate 10.

In addition, the protective substrate 30 is provided with a through hole 33 penetrating the protective substrate 30 in the thickness direction. In this embodiment, the through hole 33 is provided between the two piezoelectric element holding sections 32. The lead electrode 90 leading out of each of the piezoelectric elements 300 is exposed to the inside of the through hole 33 in the vicinity of the end thereof.

Driving circuits 200 for driving the piezoelectric elements 300 are mounted on the COF board 410 which is a flexible driving wiring. Here, the COF board 410 is adhered to the side surface of a plate-shaped support member 400, which is connected to the lead electrode 90 at the lower end thereof and substantially erected in the vertical direction. That is, the support member 400 is a cuboid of which both of the side surfaces are vertical surfaces. In this embodiment, the support member 400, the COF boards 410 and the driving circuits 200 constitute a wiring board.

In greater detail, in the head main body 1 according to this embodiment, since the pressure generating chambers 12 arranged in parallel are provided in two rows in the flow passage forming substrate 10, the piezoelectric elements 300 arranged in parallel in the width direction of the pressure generating chamber 12 (in the width direction of the piezoelectric element 300) are provided in two rows. That is, the two rows of the pressure generating chambers 12, the two rows of the piezoelectric elements 300 and the two rows of the lead electrodes 90 are provided to be opposed to each other. The COF boards 410 are respectively adhered to both of the side surfaces of the support member 400 of which the lower portion is inserted into the through hole 33. Each of the COF boards 410 is substantially erected in the vertical direction and the lower end thereof is connected to the first electrode 60 and the end of the lead electrode 90 of each row of the piezoelectric elements 300. In this embodiment, by providing one COF board 410 in each of the side surfaces of the support member 400, a total of two COF boards 410 are provided in one support member 400.

The COF board 410 which is a flexible wiring board easily warps even when erected as a single body. Accordingly, by joining the COF board 410 to the support member 400 which is a supportive rigid member, it is possible to suppress the bending of the COF board 410 and erect the COF board. However, without provision of the support member 400, only the COF board 410 may be provided so as to be upright in a direction perpendicular to the surface of the flow passage forming substrate 10, which is provided with the piezoelectric elements 300. In addition, the COF board 410 is adhered to the side surface of the support member 400, but the invention is not particularly limited thereto. For example, the COF board 410 may be held down in order to be retained on the support member 400.

In addition, as shown in FIG. 5, a buffer member 430 which can be preferably made of Teflon (registered trade name) or the like is disposed between the lower end of the COF board 410 and the lower end surface of the support member 400. The lower end of the COF board 410 and the lead electrode 90 are electrically connected to each other by conductive particles (for example, particles contained in an anisotropic conductive material such as an anisotropic conductive film (ACF) or an anisotropic conductive paste (ACP)). That is, by subjecting the support member 400 to pressurization, the COF board 410 is pressed toward the lead electrode 90 via the lower end surface of the support member. Accordingly, a predetermined electrical connection is achieved between the COF board 410 and the lead electrode 90 by crushing conductive particles. At this time, the buffer member 430 functions to make a pressing force uniform with respect to the COF board 410. Here, the lower end surface of the support member 400 and the lower end of the COF board 410, or the lower end surface of the support member 400 which is brought into contact with the buffer member 430 preferably have a surface accuracy within five times the particle diameter of the conductive particles. This is because, in combination with the presence of the buffer member 430, the pressing force which acts on the conductive particles via the lower end of the COF board 410 can be made uniform and the conductive particles are reliably crushed, so excellent electrical connection can be secured. Needless to say, the connection between the lead electrode 90 and the lower end of the COF board 410 is not limited to the conductive particles. For example, they may be connected to each other by dissolving a metal material such as solder.

In addition, it is preferable that the support member 400 has a thermal conductivity to discharge heat so that the temperature of the driving circuit 200 is lower than the junction temperature thereof even when the head main body 1 is used at its guaranteed maximum use temperature. Accordingly, even when the driving circuit is operated under the most severe load conditions, the heat discharge effect is sufficiently exhibited and thus it contributes to the stable long-term driving of the driving circuit. For this reason, in this embodiment, the support member 400 is made of stainless steel (SUS). In this case, the heat generated by the driving circuit 200 can be absorbed by ink circulating in the support member 400 via the flow passage forming substrate 10, and as a result, the heat generated by the driving circuit 200 can be effectively discharged. Even when metal such as SUS or the like is not used, the same action and effect can be obtained by sufficiently reducing the distance between the surface of the flow passage forming substrate 10 and the driving circuit 200. That is, the distance between the driving circuit 200 and the surface of the flow passage forming substrate 10 may be secured to discharge heat so that the temperature of the driving circuit 200 is lower than the junction temperature thereof even when the head main body 1 is used at its guaranteed maximum use temperature.

The support member 400 is preferably made of a material having the same linear expansion coefficient as that of a head casing 110 to be described later, and examples of this material include stainless steel, silicon and the like.

Further, as shown in FIG. 5, a compliance substrate 40 having a sealing film 41 and a fixing plate 42 is joined onto the protective substrate 30. Here, the sealing film 41 is made of a flexible material having low rigidity (for example, a polyphenylene sulfide (PPS) film) and a surface of the manifold section 31 is sealed by this sealing film 41. In addition, the fixing plate 42 is made of a hard material such as metal (for example, stainless steel (SUS)). Since the area of the fixing plate 42 which is opposed to the manifold 100 serves as an opening section 43 which is completely removed in the thickness direction, a surface of the manifold 100 is sealed only by the flexible sealing film 41.

Further, the head casing 110 is provided on the compliance substrate 40. As shown in FIG. 3, the head casing 110 is provided with an ink introducing passage 111 which communicates with an ink introducing port 44 to supply ink from a storage unit such as a cartridge to the manifold 100. In addition, in the head casing 110, a concave escape section 112 (see FIG. 5) is formed in an area opposed to the opening section 43 and flexural deformation of the opening section 43 is appropriately carried out. Further, the head casing 110 is provided with a wiring member holding hole 113 which communicates with the through hole 33 provided in the protective substrate 30, and in a state in which the COF boards 410 and the support member 400 are inserted into the wiring member holding hole 113, the lower end of the COF board 410 is connected to the lead electrode 90. The COF boards 410 and the support member 400 inserted into the wiring member holding hole 113 of the head casing 110 are adhered to the head casing 110 via an adhesive 120. Here, the COF boards 410 may be adhered to the head casing 110 via the adhesive 120. However, when the support member 400 is directly adhered to the head casing 110, the support member 400 can be reliably held in the head casing 110. That is, by adhering the support member 400 to the head casing 110, both of which are rigid, reliable connection can be maintained between the COF board 410 and the lead electrode 90 and it is possible to prevent problems such as disconnection occurring due to peel-off in the connection between the COF board 410 and the lead electrode 90. Accordingly, in this embodiment, the COF board 410 is provided with holding holes 411 penetrating therethrough in the thickness direction and they are provided at predetermined intervals in the arrangement direction of the lead electrodes 90. Via the holding holes 411, the head casing 110 and the support member 400 are adhered to each other via the adhesive 120. In addition, when the head casing 110 and the support member 400 are directly adhered to each other, the support member 400 is preferably made of a material having the same linear expansion coefficient as that of the head casing 110. In this embodiment, since the head casing 110 and the support member 400 are made of stainless steel, it is possible to prevent warping or breakdown occurring due to a difference in linear expansion coefficient between the head casing 110 and the support member 400 when the head bodies 1 are contracted or expanded due to heat. When the head casing 110 and the support member 400 are made of materials having different linear expansion coefficients, respectively, the support member 400 presses the flow passage forming substrate 10 and thus there is concern that cracks may be caused in the flow passage forming substrate 10. Further, the head casing 110 and the support member 400 are more preferably made of a material having almost the same linear expansion coefficient as that of the protective substrate 30 to which the head casing and the support member are fixed.

In such a head main body 1, the COF board 410 protrudes on the opposite side to the ink discharge surface having the nozzle openings 21.

As shown in FIGS. 1 and 2, the ink jet recording head I of this embodiment further includes the supply passage forming member 500 provided on the side of the COF board 410 of the head main body 1, the circuit board 600 provided on the side of the supply passage forming member 500 opposite to the head main bodies 1 and the fixing member 700 provided on the side of the supply passage forming member 500 opposite to the head main bodies 1.

Figure 6A:
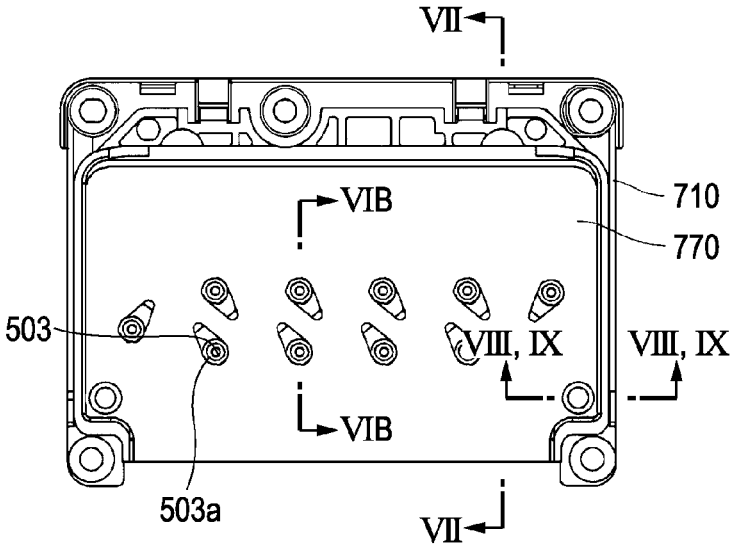
FIG. 6A is a plan view showing a main part of the recording head according to the first embodiment of the invention.
Figure 6B:
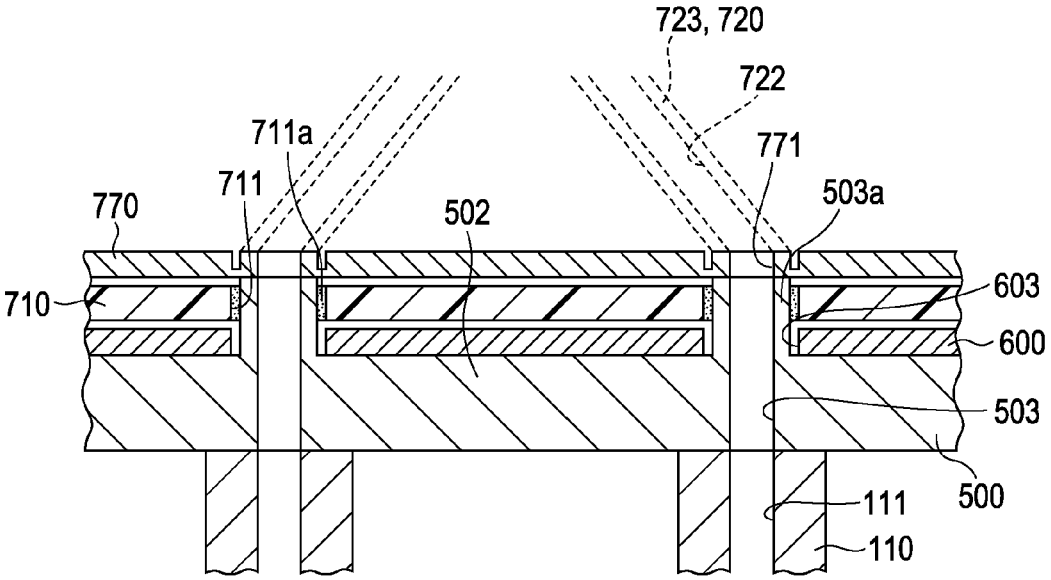
FIG. 6B is a cross-sectional view of the recording head according to the first embodiment of the invention.
Figure 7:
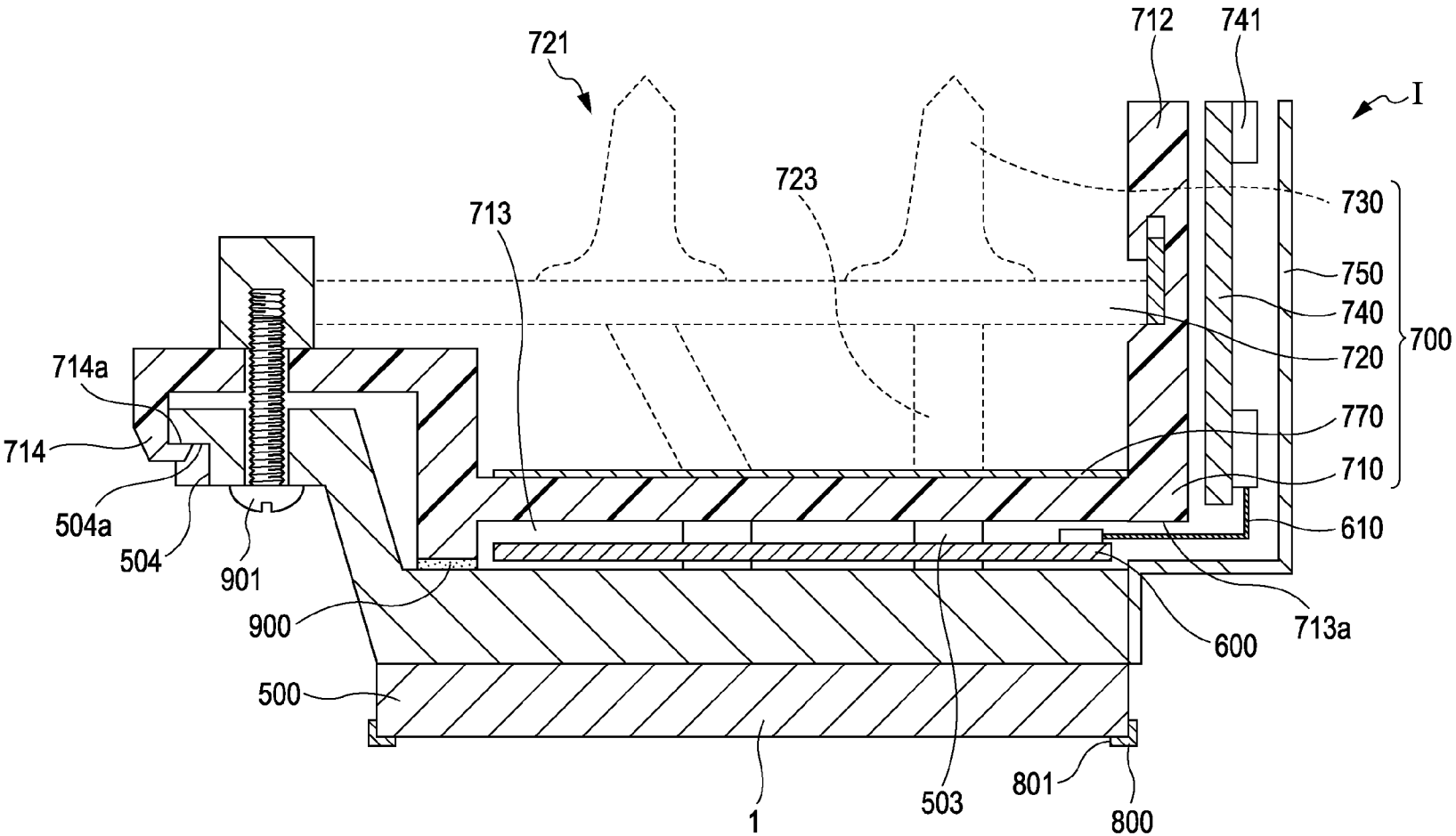
FIG. 7 is a cross-sectional view showing a main part of the recording head according to the first embodiment of the invention.
Figure 8:
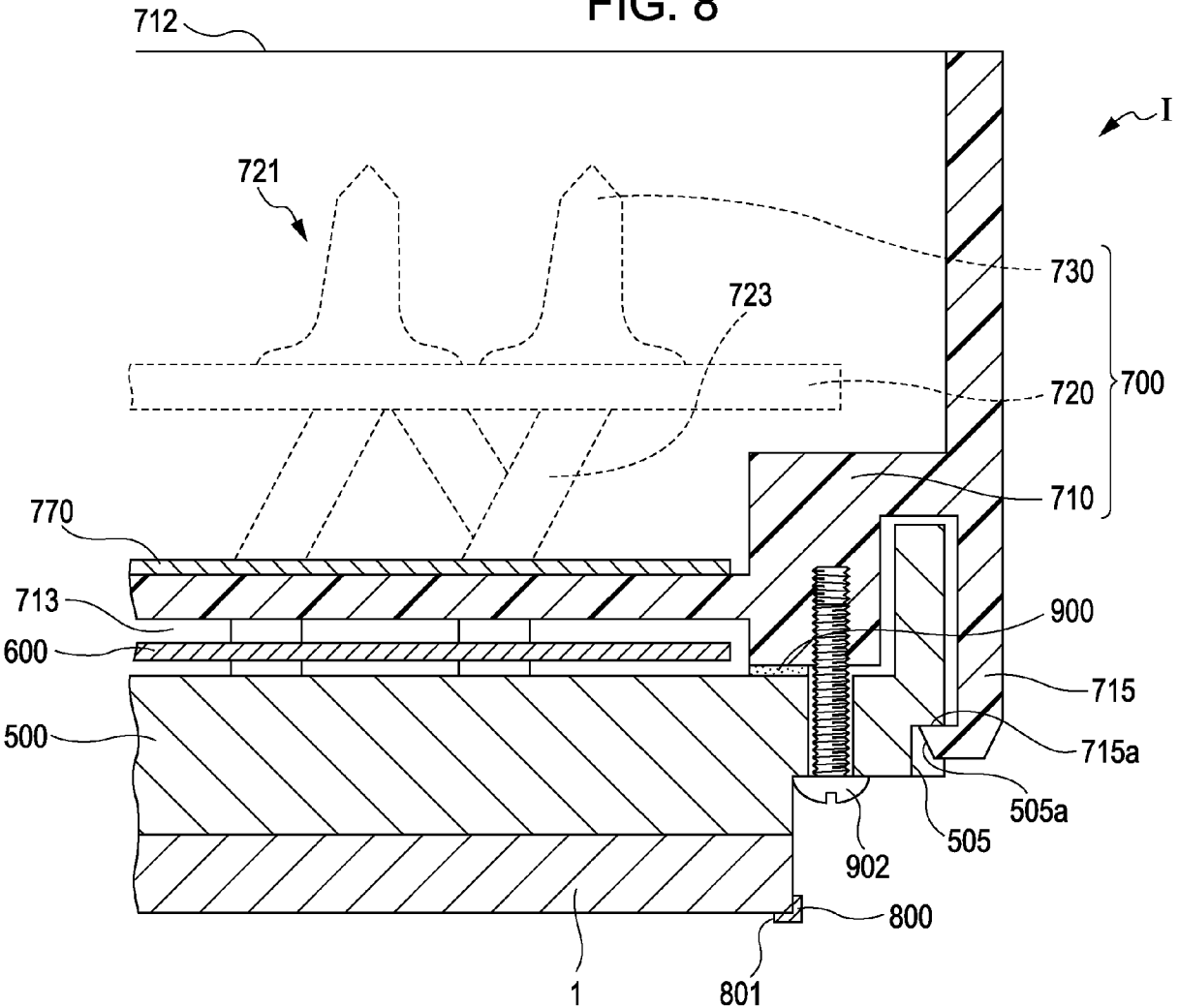
FIG. 8 is a cross-sectional view showing a main part of the recording head according to the first embodiment of the invention.

The supply passage forming member 500 will be described with further reference to FIGS. 6 to 9. FIG. 6A is a plan view showing a main part of the ink jet recording head and FIG. 6B is a view schematically showing the cross-section taken along the line VIB-VIB of FIG. 6A. FIG. 7 is a view schematically showing the cross-section taken along the line VII-VII of FIG. 6A and FIG. 8 is a view schematically showing the cross-section taken along the line VIII-VIII of FIG. 6A.

As shown in FIGS. 1 and 2, the plurality of head main bodies 1 is fixed to the bottom surface of the supply passage forming member 500 which is a first holding member of this embodiment. In this embodiment, five head main bodies are fixed in the arrangement direction of the nozzle array in the head main body 1.

As shown in FIG. 1, the supply passage forming member 500 is partitioned by partition walls 502 and through holes 501 are formed which penetrate the supply passage forming member 500 in the thickness direction. The COF boards 410 and the support member 400 of each head main body 1 are inserted into the through hole 501 and the head main bodies 1 are fixed to the circumference of the respective through holes 501.

In addition, as shown in FIG. 6B, the partition wall 502 forming the through hole 501 (see FIG. 1) is provided with a supply passage 503 which communicates with the ink introducing passage 111 provided in the head casing 110 of the head main body 1 to supply ink. The supply passage 503 is opened to the head main body 1 of the supply passage forming member 500 and is provided to pass through in the thickness direction so as to be opened to the fixing member 700. In addition, one partition wall 502 has the plurality of supply passages 503, for example, two supply passages. Further, the opening of the supply passage 503 on the side of the circuit board 600 is provided to be an end surface of a protrusion 503*a*. When this protrusion 503*a* is inserted into an insertion hole 603 of the circuit board 600 to be described later in detail, the supply passage 503 opened to the end surface of the protrusion 503*a* communicates with introduction hole 722 of the fixing member 700 to be described later.

In addition, as shown in FIGS. 1 and 2, the ink discharge surface having the nozzle openings 21 of the head main body 1 fixed to the supply passage forming member 500 is provided with the cover head 800 common to the plurality of head main bodies 1. The cover head 800 is provided with a window 801 exposing the nozzle openings 21 of the head main bodies 1 and ink droplets are discharged from the nozzle openings 21 exposed via the window 801.

Further, as shown in FIGS. 1 and 2, the circuit board 600 is held on the side of the supply passage forming member 500 opposite to the head main bodies 1.

The circuit board 600 is mounted with various wirings and electronic components and is provided with connection holes 602 penetrating therethrough in the thickness direction. The tip end of the COF board 410 which is a driving wiring of the head main body 1 is inserted into the connection hole 602 and bent, thereby being electrically connected to the circuit board 600.

In addition, as shown in FIG. 6B, as described above, the circuit board 600 is provided with the insertion hole 603 into which the protrusion 503*a* of the supply passage forming member 500 is inserted. When the protrusion 503*a* of the supply passage forming member 500 is inserted into the insertion hole 603, the supply passage 503 provided in the protrusion 503*a* is opened to the outside of the circuit board 600 (on the opposite side to the supply passage forming member 500) and is connected to the introduction hole 722 of the fixing member 700 to be described later.

In addition, as shown in FIG. 7, the circuit board 600 is electrically connected to an external wiring connection board 740 fixed to the side surface of the fixing member 700. An external wiring (not shown) to which a driving signal or the like for driving the piezoelectric element 300 is input is electrically connected to the external wiring connection board 740 and a driving signal or the like from the external wiring is supplied to the head main body 1 (COF board 410) via the external wiring connection board 740 and the circuit board 600.

As shown in FIGS. 1 and 7, the fixing member 700 includes a base member 710 fixed to a surface (a surface where the circuit board 600 is fixed) of the supply passage forming member 500 on the opposite side to the head main body 1, a supply needle holder 720 having a plurality of supply needles 730, the external wiring connection board 740 fixed to one side surface of the base member 710 and a protective member 750 covering the external wiring connection board 740.

The base member 710 is a second holding member of this embodiment. A surface thereof is fixed to the side of the circuit board 600 of the supply passage forming member 500 and thus the circuit board 600 is maintained between this surface and the supply passage forming member 500.

In addition, as shown in FIG. 6B, the base member 710 is provided with an insertion communication hole 711 into which the protrusion 503*a* of the supply passage forming member 500 is inserted. Since the protrusion 503*a* of the supply passage forming member 500 communicates with the insertion hole 603 provided in the circuit board 600 and the insertion communication hole 711 provided in the base member 710, the supply passage 503 which is provided in the end surface of the protrusion is exposed to the supply needle holder 720. In addition, the insertion communication hole 711 of the base member 710 and the protrusion 503*a* are sealed by an adhesive 711*a* and the invasion of ink to the circuit board 600 from between the insertion communication hole 711 and the protrusion 503*a* is suppressed.

In this embodiment, the holding members holding the head main body 1 and inwardly holding the circuit board 600 include the supply passage forming member 500 which is the first holding member and the base member 710 which is the second holding member. That is, the supply passage forming member 500 is provided as the first holding member which holds the head main body 1, and the base member 710 is provided as the second holding member which holds the circuit board 600 with the first holding member (supply passage forming member 500).

The holding member flow passage which is provided in the holding member corresponds to the supply passage 503 provided in the supply passage forming member 500 which is the first holding member. The holding member flow passage may be provided only in the first holding member, only in the second holding member, or in both of the first and second holding members if it can be connected to the head main body 1 and the flow passage member including the supply needle holder 720 and the supply needles 730. That is, the holding member flow passage may be provided in any one of the first holding member and the second holding member or in both of them. However, in order to reduce the number of connection sites between the flow passages to thereby suppress leakage of ink from the connection sites, the holding member flow passage is preferably provided only in the first holding member or the second holding member.

In addition, as shown in FIG. 7, the circuit board 600 is held in a circuit board holding section 713 which is a space provided between the supply passage forming member 500 and the base member 710.

The circuit board holding section 713 is sealed by an adhesive 900 at the side where a connection wiring 610 is connected to the circuit board 600, that is, at the area outside the protective member 750. The protective member 750 to be described later in detail covers the opening of the circuit board holding section 713, which is not adhered by the adhesive 900, to seal the circuit board holding section 713. That is, in this embodiment, the circuit board holding section 713 is provided with a connection wiring insertion hole 713*a* which is opened to the protective member 750 and into which the connection wiring 610 is inserted.

Further, as shown in FIGS. 7 and 8, the supply passage forming member 500 and the fixing member 700 are fixed by screw members 901 and 902. In this embodiment, the supply passage forming member 500 and the fixing member 700 are fixed by total four members, that is, the two screw members 901 provided in the side surface on the opposite side to a holding wall 712, to be described later, at the outer circumference and the two screw members 902 respectively provided in side surfaces at both sides of the side surface (side surfaces intersecting the holding wall 712). Here, as shown in FIG. 7, the two screw members 901 provided on the opposite side to the holding wall 712 at the outer circumference penetrate the supply passage forming member 500 and the base member 710 and are screwed to the supply needle holder 720 fixed to the base member 710. Accordingly, the supply passage forming member 500 and the fixing member 700 are fixed to each other. In addition, as shown in FIG. 8, the screw members 902 provided in both of the side surfaces of the holding wall 712 penetrate the supply passage forming member 500 and are screwed to the base member 710. Accordingly, the supply passage forming member 500 and the fixing member 700 are fixed to each other.

Further, as shown in FIG. 1, in the base member 710, engaging claws 714 and 715 engaging with to-be-engaged sections of the supply passage forming member 500 are provided in two or more side surfaces at the circumference.

In this embodiment, as shown in FIG. 7, the two engaging claws 714 are provided in the side surface at the side where the two screw members 901 on the opposite side to the holding wall 712 are provided, and as shown in FIG. 8, the engaging claws 715 are respectively provided in both of the side surfaces of the holding wall 712. That is, when viewing the base member 710 from the top, the engaging claws 714 and 715 are provided in the three sides of the rectangular base member 710.

As shown in FIG. 1, such engaging claws 714 and 715 are formed to be elastically deformed by cutting out a part of the outer circumference of the base member 710. Engaging surfaces 714*a* and 715*a* provided at the tip ends thereof are brought into contact with a surface of the outer circumferential surface of the supply passage forming member 500 on the opposite side to the base member 710 and thus engagement is achieved.

The supply passage forming member 500 is provided with to-be-engaged sections 504 and 505 with which the engaging claws 714 and 715 are engaged. In this embodiment, as shown in FIG. 7, the to-be-engaged sections 504 engage with the engaging claws 714, and as shown in FIG. 8, the to-be-engaged sections 505 engage with the engaging claws 715. Such to-be-engaged sections 504 and 505 are formed by cutting out a part of the outer circumference of the supply passage forming member 500 on the side of the head main body 1. The engaging surfaces 714*a* and 715*a* of the engaging claws 714 and 715 are brought into contact with to-be-engaged surfaces 504*a* and 505*a*, which are respectively provided on the side of the head main body 1, of the to-be-engaged sections 504 and 505 and thus engagement is achieved.

Here, in this embodiment, the base member 710 is tilted with respect to the supply passage forming member 500, and first, the engaging claw 714 shown in FIG. 7 is engaged with the to-be-engaged section 504 of the supply passage forming member 500 and then the engaging claw 715 shown in FIG. 8 is engaged with the to-be-engaged section 505 of the supply passage forming member 500. Accordingly, the engaging surface 714*a* of the engaging claw 714 shown in FIG. 7 is formed so that the clearance between the above engaging surface and the to-be-engaged surface 504*a* of the to-be-engaged section 504 is equal to or less than zero. This is because, for example, when the clearance between the engaging surface 714*a* of the engaging claw 714 and the to-be-engaged surface 504*a* of the to-be-engaged section 504 is below zero and interference occurs therebetween, the engaging claw 714 made of a material such as a resin is deformed by trying to engage the engaging claw 714 and the clearance between the engaging surface 714*a* and the to-be-engaged surface 504*a* becomes zero, therefore engagement can be previously achieved with no gap.

In addition, in this embodiment, the engaging surface 715*a* of the engaging claw 715 shown in FIG. 8 is formed so that the clearance between the above engaging surface and the to-be-engaged surface 505*a* of the to-be-engaged section 505 is equal to or greater than zero. This is because, for example, when the clearance between the engaging surface 715*a* of the engaging claw 715 shown in FIG. 8 and the to-be-engaged surface 505*a* of the to-be-engaged section 505 is below zero (interference), it is difficult to achieve engagement and assemblability decreases. When clearance equal to or greater than zero is achieved between the to-be-engaged section 505 and the engaging claw 715 which will be engaged, engagement is easily achieved and assemblability can be improved.

In addition, as shown in FIGS. 1 and 7, the supply needle holder 720 is fixed to the side of the base member 710 opposite to the head main body 1.

Further, one side surface (surface intersecting the surface to which the supply passage forming member 500 and the supply needle holder 720 are fixed) of the base member 710 has the holding wall 712 and the external wiring connection board 740 is fixed to the outside of the holding wall 712.

The external wiring connection board 740 is connected to the circuit board 600 via the connection wiring 610. In addition, the external wiring connection board 740 is provided with a connector 741 at the upper end thereof (on the opposite side to the circuit board 600) and an external wiring such as a control cable from a control device is electrically connected to the connector 741.

The supply needle holder 720 is fixed to the side of the base member 710 opposite to the supply passage forming member 500 via a sealing member 770 made of rubber or the like, and has a cartridge mounting section 721, on which an ink cartridge as a storage unit storing ink is mounted, on the opposite side to the surface fixed to the base member 710.

In addition, as shown in FIGS. 2 and 6B, in the bottom surface of the supply needle holder 720, tubular supply communication passage forming sections 723 protrude which have a plurality of introduction holes 722, of which one end is opened to the cartridge mounting section 721 and the other end is opened to the base member 710, respectively. The introduction hole 722 is connected to the supply passage 503 via a supply communication passage 771 provided in the sealing member 770.

In addition, the plurality of supply needles 730 is fixed to the upper surface of the supply needle holder 720, that is, in the openings of the introduction holes 722 of the cartridge mounting section 721 via filters 731 (see FIG. 2) for removing bubbles and foreign substances in ink.

Each of the supply needles 730 has therein a penetration passage (not shown) communicating with the introduction hole 722. By inserting the supply needle 730 into an ink cartridge, the ink in the ink cartridge is supplied to the introduction hole 722 of the supply needle holder 720 via the penetration passage of the supply needle 730. The ink introduced into the introduction hole 722 is supplied to the supply passage 503 via the supply communication passage 771 provided in the sealing member 770 and then supplied to the ink introducing passage 111 of the head main body 1 via the supply passage 503.

In this embodiment, the supply needle holder 720 and the supply needles 730 are provided as a supply member having introduction holes 722 which supplies ink to the holding member flow passages (supply passage 503) of the supply passage forming member 500 and the base member 710 which are holding members.

As shown in FIG. 7, the protective member 750 has a box shape provided outside the holding wall 712 and having openings in the upper surface and one side surface thereof. The protective member is fixed to the side surfaces of the base member 710 and the supply passage forming member 500 which are holding members in order to cover the external wiring connection substrate 740 fixed to the holding wall 712 as described above.

The protective member 750 is opened to the connector 741 (upper side) of the external wiring connection substrate 740 and thus the connector 741 can be connected to an external wiring.

Due to protection of the external wiring connection substrate 740 by this protective member 750, it is possible to prevent problems such as damage occurring by hitting of an object from the outside to the external wiring connection substrate 740 and disconnection occurring due to adhesion of foreign substances such as ink and dust, and due to sealing of the circuit board holding section 713 which is a space connecting the circuit board 600 and the COF boards 410 by the adhesive 900, except for a partial area around the connector 741 disposed on the upper side, it is possible to suppress invasion of ink to the inside. In the ink jet recording head I, the ink discharge surface is in the lower portion of FIG. 1. That is, the ink discharge surface is the surface of the external wiring connection substrate 740 opposite to the connector 741. Accordingly, even when the ink discharge surface is opened to the connector 741, it is difficult for ink to enter the inside. In addition, when openings around this connector 741 are blocked with a resin or the like, it is possible to further reliably prevent invasion of ink.

Figure 9A:
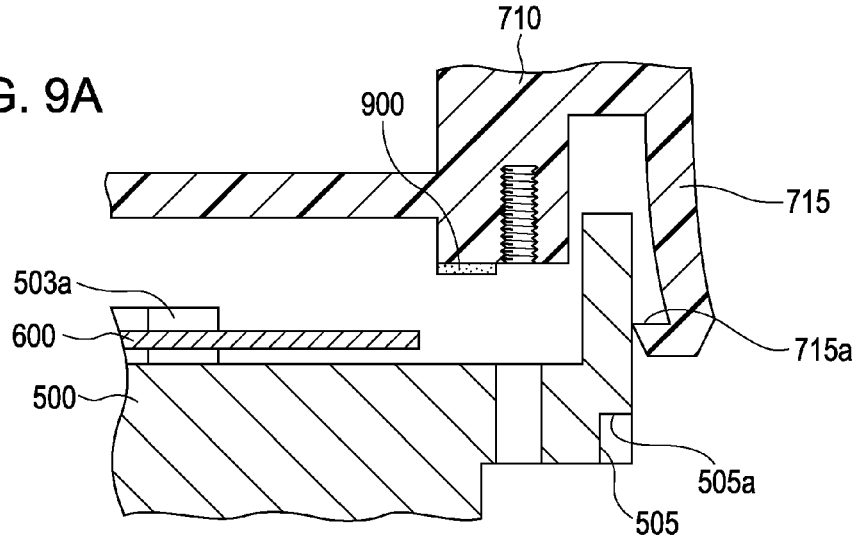
FIG. 9A is a cross-sectional view showing a method of manufacturing the recording head according to the first embodiment of the invention.
Figure 9B:
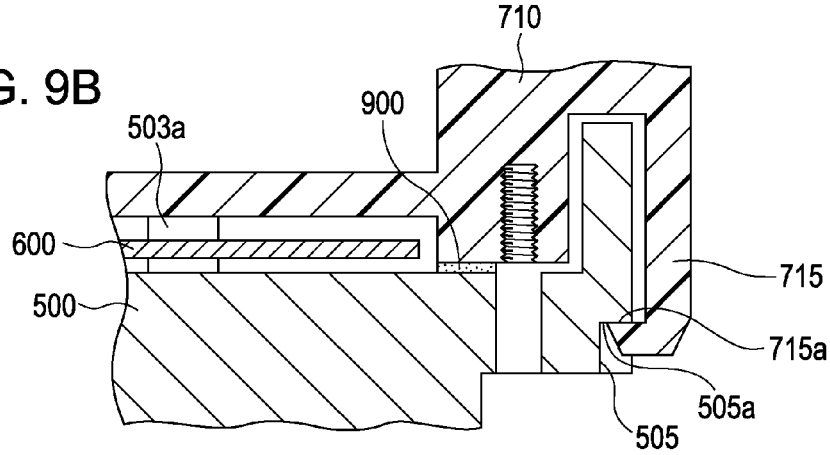
FIG. 9B is a cross-sectional view showing the method of manufacturing the recording head according to the first embodiment of the invention.
Figure 9C:
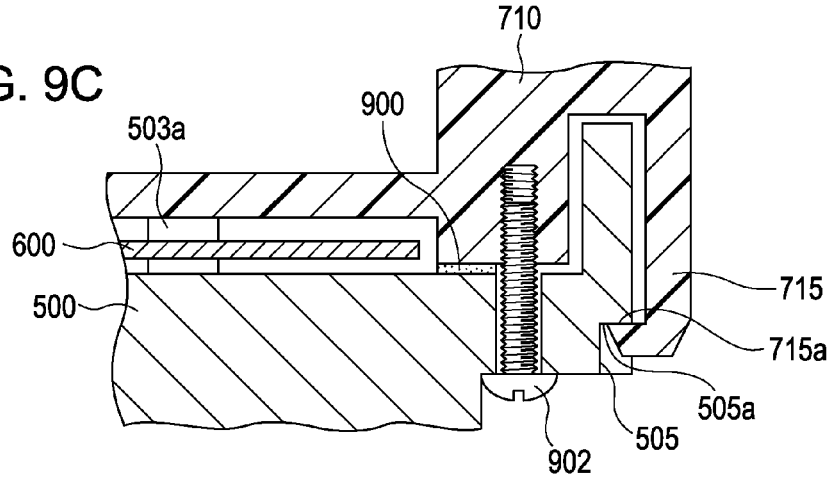
FIG. 9C is a cross-sectional view showing the method of manufacturing the recording head according to the first embodiment of the invention.

Here, a method of manufacturing the ink jet recording head I of this embodiment, particularly, a method of assembling the supply passage forming member and the base member will be described. FIGS. 9A to 9C are enlarged cross-sectional views of a main part taken along the line IX-IX and show the assembling method. In the examples shown in FIGS. 9A to 9C, a case of the engaging claw 715 is described, but the same situation occurs also in a case of the engaging claw 714.

First, as shown in FIG. 9A, in a state in which the circuit board 600 is placed on the supply passage forming member 500, an adhesive is applied to the base member 710 and the base member 710 is fitted on the side of the supply passage forming member 500. At this time, the engaging claw 715 of the base member 710 is elastically deformed and thus the engaging claw 715 extends and moves to the outer circumference of the supply passage forming member 500.

Next, as shown in FIG. 9B, the engaging claw 715 of the base member 710 is engaged with the to-be-engaged section 505. At this time, as described above, the engaging claw shown 714 in FIG. 7 is engaged with the to-be-engaged section 504 and then the engaging claw 715 shown in FIG. 8 is engaged with the to-be-engaged section 505.

In this manner, by the engaging claw 715, the supply passage forming member and the base member are engaged and formed integrally with each other.

Then, as shown in FIG. 9C, the supply passage forming member 500 and the base member 710 are fixed to each other by the screw member 902. At the same time, as shown in FIG. 7, the supply passage forming member 500 and the base member 710 are fixed to each other by the screw member 901.

In this manner, due to engagement of the supply passage forming member 500 with the base member 710 by the engaging claws 714 and 715, it is possible to suppress curing of the adhesive 900 in a state in which positional deviation occurs between the supply passage forming member 500 and the base member 710 while the supply passage forming member and the base member are fixed by the screw members 901 and 902.

Figure 10:
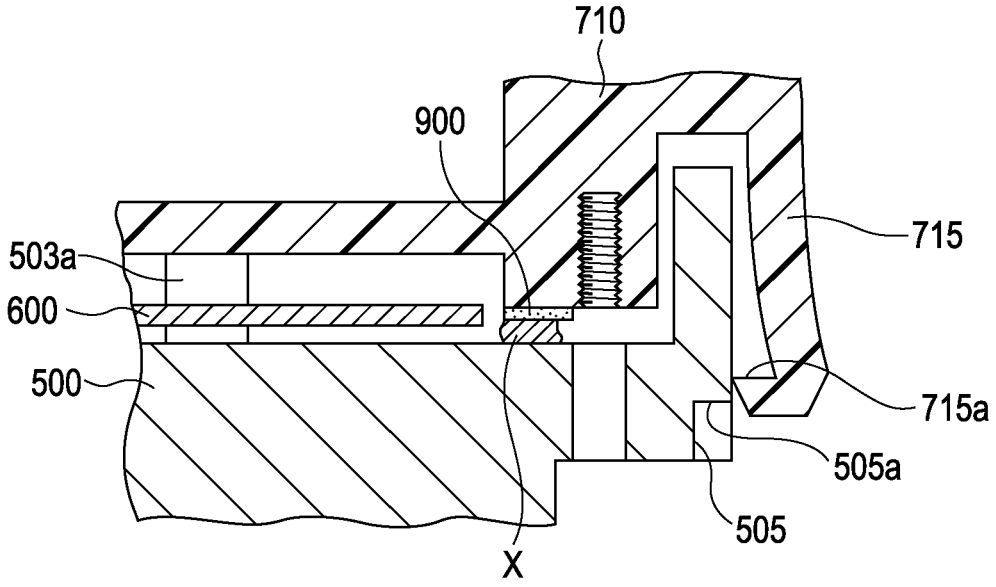
FIG. 10 is a cross-sectional view showing a recognition state of the recording head according to the first embodiment of the invention.

In addition, due to engagement of the supply passage forming member 500 with the base member 710 by the engaging claws 714 and 715, it is possible to recognize the fact that a foreign substance has entered the adhesion surfaces which are adhered to each other by the adhesive 900 and other surfaces which are brought into contact with each other. That is, as shown in FIG. 10, when a foreign substance X is present on the surface where the supply passage forming member 500 and the base member 710 adhere to each other, the engaging claw 715 does not engage with the to-be-engaged section 505. Accordingly, just by visually checking the engagement state of the engaging claw 715 (also in the case of the engaging claw 714), it is possible to recognize whether the foreign substance X is present on the adhesion surface or the contact surface between the supply passage forming member and the base member. Even when the foreign substance X is not present, clearance variation occurring by insufficient pressing of the supply passage forming member 500 and the base member 710 is ascertained just by visually checking the engagement state of the engaging claw 715 (also in the case of the engaging claw 714) and thus the clearance can be easily controlled. In addition, when positional deviation occurs between the supply passage forming member 500 and the base member 710 due to the foreign substance X or the subsequent process, errors occur in connection between the supply passage 503 of the supply passage forming member 500 and the introduction hole 722 of the supply needle holder 720 because the supply passage 503 is provided in the supply passage forming member 500 and the supply passage 503 communicates with the introduction hole 722 of the supply needle holder 720 via the sealing member 770. Accordingly, a problem occurs in that there is concern that ink will invade the circuit board 600 and the like. In addition, due to positional deviation between the supply passage forming member 500 and the base member 710, a problem also occurs in that other members such as the supply needle holder 720 and the protective member 750 cannot be fixed.

In this embodiment, due to adhesion of the supply passage forming member 500 and the base member 710 constituting the holding members to each other by the adhesive 900 and engagement of the engaging claws 714 and 715 provided in the base member 710 which is one of the holding members with the to-be-engaged sections 504 and 505 of the supply passage forming member 500 which is the other holding member, it is possible to suppress positional deviation before the adhesive 900 is cured or before the supply passage forming member and the base member are fixed to each other by the screw members 901 and 902. In addition, just by ascertaining the engagement state of the engaging claws 714 and 715, it is possible to easily recognize whether the foreign substance X is present on the contact surface or the adhesion surface between the supply passage forming member and the base member and control clearance.

In addition, in this embodiment, the circuit board 600 is connected to the COF boards 410 of the head main body 1 between the supply passage forming member 500 and the fixing member 700. The circuit board 600 connected to the COF boards 410 is connected to the external wiring connection substrate 740 provided in the fixing member 700 which is a member different from the supply passage forming member 500.

The supply passage forming member 500 holding the head main body 1 and the fixing member 700 holding the external wiring connection substrate 740 are separate members. Accordingly, before the supply passage forming member 500 and the fixing member 700 are joined to each other, the circuit board 600 and the COF boards 410 can be connected to each other in a state in which the head main body 1 and the supply passage forming member 500 are joined to each other. Accordingly, the COF boards 410 and the circuit board 600 can be easily connected to each other and the circuit board 600 and the external wiring connection substrate 740 can be easily connected to each other.

In addition, in the ink jet recording head I of this embodiment, the supply passage forming member 500 and the fixing member 700 are separate members and the circuit board 600 and the COF boards 410 are connected to each other between the supply passage forming member 500 and the fixing member 700. Accordingly, handling of the circuit board 600 is simplified, and thus the plurality of head main bodies 1 can be easily connected to one circuit board 600, the size of the ink jet recording head I can be reduced and costs can be reduced. When the supply passage forming member 500 and the fixing member 700 are formed integrally with each other, the plurality of head main bodies 1 cannot be easily connected to one circuit board 600. This is because, since it is substantially difficult to form a space over the partition walls 502 when the supply passage forming member 500 and the fixing member 700 are formed by molding, a space holding the circuit board 600 between the supply passage forming member 500 and the fixing member 700 cannot be formed, and thus only the through holes each formed for each head main body 1 can be provided and circuit boards which are divided by the same number as the number of the plurality of head main bodies 1 are needed. In addition, when a circuit board is provided for each head main body 1, the number of components increases and thus costs increase. Moreover, when the supply passage forming member 500 and the fixing member 700 are formed integrally with each other, there is concern that, when the head main bodies 1 and the supply passage forming member 500 are adhered to each other, in a state in which an individual circuit board is connected to each of the head main bodies 1, the head main body 1 and the circuit board should be inserted into the through hole, and the adhesive adhering the head main bodies 1 and the supply passage forming member 500 to each other easily adheres to the circuit boards and the like, and thus errors occur in connection between the circuit boards and the external wiring connection substrate due to the extra adhesive and errors occur in adhesion due to the insufficient adhesive adhering the head main bodies 1 and the supply passage forming member 500 to each other. Even in this embodiment, even when the circuit board 600 is provided for each head main body 1 or each group of the head main bodies 1, the circuit boards 600 and the COF boards 410 can be reliably connected to each other due to simplification of handling of the circuit boards 600.

In the ink jet recording head I having such a configuration, the ink from an ink cartridge is taken into the manifold 100 via the introduction hole 722, the supply communication passage 772, the supply passage 503, the ink introducing passage 111 and the ink introducing port 44 to fill the flow passages from the manifold 100 to the nozzle openings 21, and then a voltage is applied to each piezoelectric element 300 corresponding to each pressure generating chamber 12 in accordance with a recording signal supplied via the circuit board 600 and the COF board 410 from the external wiring connection substrate 740 to subject the piezoelectric element 300 and the oscillating plate to flexural deformation, and thus the pressure in each pressure generating chamber 12 increases and ink droplets are ejected from the nozzle openings 21.

Other Embodiments

As described above, an embodiment of the invention has been described, but the basic configuration of the invention is not limited to the above description.

For example, in the above-described first embodiment, the engaging claws 714 and 715 are provided in the base member 710 which is the second holding member, but the invention is not particularly limited thereto. For example, the engaging claws 714 and 715 may be provided in the supply passage forming member 500 which is the first holding member.

In addition, in the above-described first embodiment, the COF board 410 is provided in each side surface of the support member 400. However, in each side surface, two or more COF boards 410 may be provided. In addition, for example, the COF boards 410 may be provided only in one side surface of the support member 400 and one continuous COF board may be used as the COF boards 410 in both of the side surfaces. Contrary to this, the driving circuits 200 may be provided in a different place and the board may not be the COF board but may be a wiring board mounted with no circuits. Only the COF boards 410 may be provided without provision of the support member 400.

Further, in the above-described first embodiment, the pressure generating chambers 12 arranged in parallel are provided in two rows in the flow passage forming substrate 10, but in this case, the number of rows is not particularly limited. They may be provided in one row or in three or more rows. In the case in which the number of rows is more than one, a pair of at least two rows may be provided to be opposed to each other.

In addition, in the above-described first embodiment, the description has been made in which the actuator device having the thin-film piezoelectric element 300 is used as the pressure generating element which changes the pressure in the pressure generating chamber 12, but the pressure generating element is not particularly limited thereto. For example, a thick-film actuator device which is formed by a green sheet adhesion method or the like, or a longitudinal oscillation actuator device in which a piezoelectric material and an electrode forming material are alternately laminated and are expanded and contracted in the axial direction may be used. In addition, as the pressure generating element, a heater element may be disposed in the pressure generating chamber to discharge liquid droplets from the nozzle openings by bubbles which are generated due to the heat generated by the heater element, or a so-called static actuator may be used to generate static electricity between the oscillating plate and the electrode so as to deform the oscillating plate by the electrostatic force, thereby discharging liquid droplets from the nozzle openings.

Figure 11:
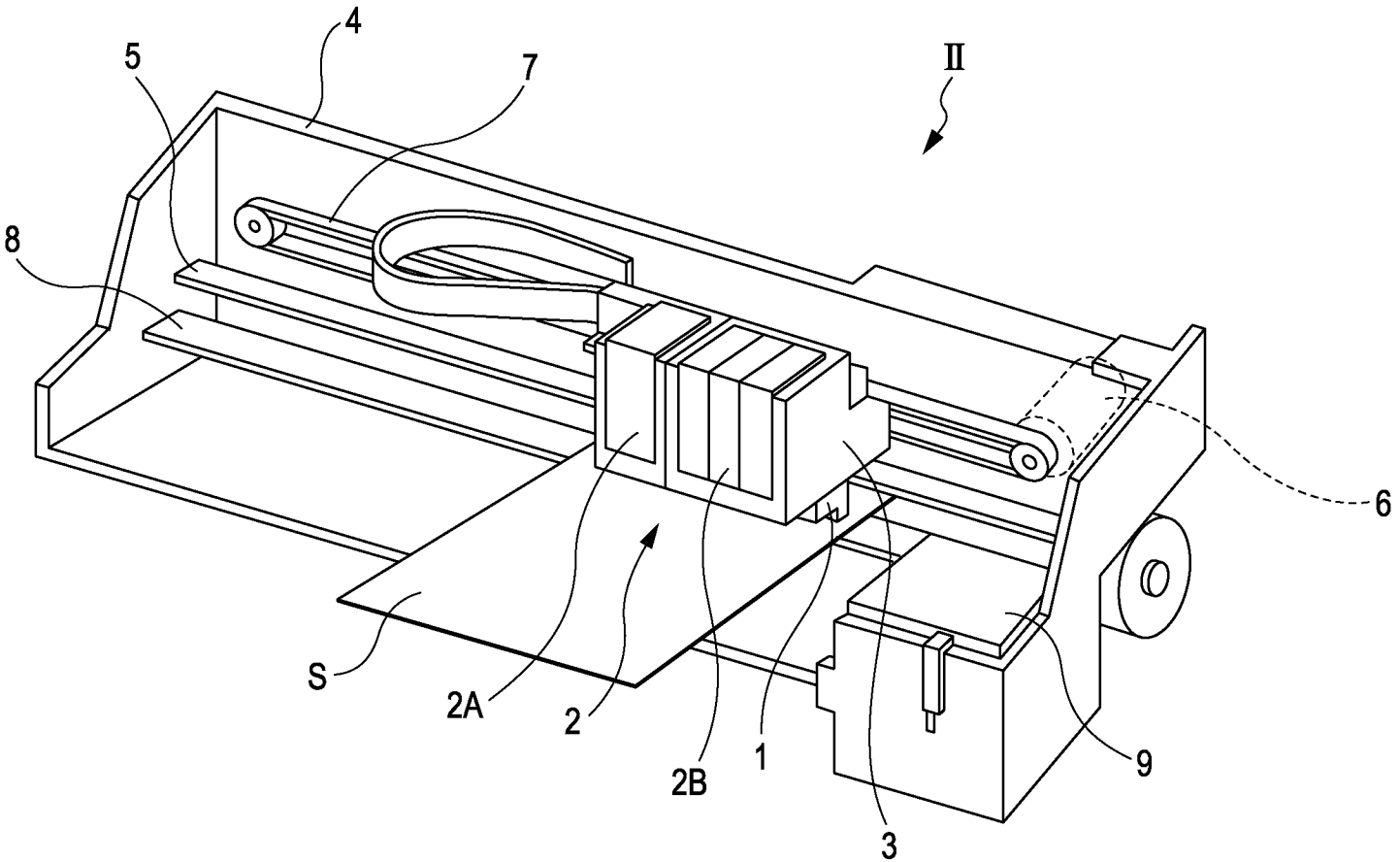
FIG. 11 is a schematic view showing an ink jet recording apparatus according to an embodiment.

In addition, the ink jet recording head of these embodiments, which partially constitutes an ink jet recording head unit having an ink flow passage communicating with an ink cartridge or the like, is mounted on an ink jet recording apparatus. FIG. 11 is a schematic view showing an example of the ink jet recording apparatus.

In an ink jet recording apparatus II shown in FIG. 11, in an ink jet recording head unit 2 (hereinafter, also referred to as the head unit) having a plurality of ink jet recording heads I, cartridges 2A and 2B constituting an ink supply unit are removably provided. A carriage 3 mounted with this head unit 2 is provided on a carriage shaft 5 attached to an apparatus main body 4 to be movable in the axial direction. This recording head unit 2 discharges, for example, a black ink composition and color ink compositions.

When the driving force of a driving motor 6 is transmitted to the carriage 3 via a timing belt 7 and a plurality of gears (not shown), the carriage 3 mounted with the head unit 2 is moved along the carriage shaft 5. The apparatus main body 4 is provided with a platen 8 along the carriage shaft 5, and a recording sheet S which is a recording medium such as paper supplied from a paper feeding roller (not shown) or the like is wounded on the platen 8 and transported.

In addition, in the ink jet recording apparatus II, the example is shown in which the ink jet recording heads I (head unit 2) are mounted on the carriage 3 and moved in the main scanning direction, but the invention is not particularly limited thereto. The invention can be applied to, for example, a so-called line recording apparatus in which the ink jet recording heads I is fixed and printing is performed just by moving a recording sheet S such as paper in the auxiliary scanning direction.

The invention targets general liquid ejecting heads, and for example, the invention can also be applied to recording heads such as various kinds of ink jet recording heads which are used in image recording apparatuses such as a printer, color material ejecting heads which are used in manufacturing of color filters such as a liquid crystal display, electrode material ejecting heads which are used in forming of electrodes of an organic EL display, a field emission display (FED) or the like, biological organic material ejecting heads which are used in manufacturing of biochips, and the like.

What is claimed is:

1. A liquid ejecting head comprising:

a head main body which is provided with nozzle openings ejecting liquid;

a holding member which has a first holding member mounted on the side of the head main body opposite to the nozzle openings, a second holding member mounted on the side of the first holding member opposite to the head main body via an adhesive, and a holding member flow passage communicating with a liquid flow passage of the head main body; and a circuit board which is held in a circuit board holding section corresponding to a space between the first and second holding members and to which a driving wiring of the head main body is connected, wherein the circuit board holding section between the first and second holding members is sealed by an adhesive in an area other than an area where a connection wiring is connected to the circuit board, the first and second holding members are fixed to each other by engaging engaging claws, which are provided in two or more side surfaces at the outer circumference of one of the first and second holding members, with the other holding member, and the first and second holding members are fixed to each other by screw members.

2. The liquid ejecting head according to claim 1, wherein a flow passage member provided with an introduction hole communicating with the holding member flow passage is fixed to the side of the holding member opposite to the head main body.

3. A liquid ejecting head unit comprising:

the liquid ejecting head according to claim 2.

4. A liquid ejecting apparatus comprising:

the liquid ejecting head unit according to claim 3.

5. A liquid ejecting apparatus comprising:

the liquid ejecting head according to claim 2.

6. The liquid ejecting head according to claim 1, wherein the holding member flow passage is provided in the first holding member.

7. A liquid ejecting head unit comprising:

the liquid ejecting head according to claim 6.

8. A liquid ejecting apparatus comprising:

the liquid ejecting head unit according to claim 7.

9. A liquid ejecting apparatus comprising:

the liquid ejecting head according to claim 6.

10. The liquid ejecting head according to claim 1, wherein a connection wiring insertion hole into which a connection wiring connected to the circuit board is inserted is provided in a side surface intersecting the surface to which the head main body is fixed, and is covered by a protective member which is opened to the side opposite to the surface to which the head main body is fixed.

11. A liquid ejecting head unit comprising:

the liquid ejecting head according to claim 10.

12. A liquid ejecting apparatus comprising:

the liquid ejecting head unit according to claim 11.

13. A liquid ejecting apparatus comprising:

the liquid ejecting head according to claim 10.

14. The liquid ejecting head according to claim 1, wherein the engaging claw provided in one side at the outer circumference of one of the first and second holding members is provided so that when the engaging claw engages with the other holding member, the clearance therebetween is equal to or less than zero, and the engaging claw provided in another side is provided so that when the engaging claw engages with the other holding member, the clearance therebetween is equal to or greater than zero.

15. A liquid ejecting head unit comprising:

the liquid ejecting head according to claim 14.

16. A liquid ejecting apparatus comprising:

the liquid ejecting head according to claim 14.

17. A liquid ejecting head unit comprising:

the liquid ejecting head according to claim 1.

18. A liquid ejecting apparatus comprising:

the liquid ejecting head unit according to claim 17.

19. A liquid ejecting apparatus comprising:

the liquid ejecting head according to claim 1.

* * * * *